United States Patent [19]

Buckner et al.

[11] 4,301,783

[45] Nov. 24, 1981

[54] THREE WALL FORCED AIR HEATING UNIT

[75] Inventors: Carrol E. Buckner; C. Glenn Cook, both of Weaverville; Thomas J. Kane, Asheville, all of N.C.

[73] Assignee: Cebu Corporation, Asheville, N.C.

[21] Appl. No.: 950

[22] Filed: Jan. 4, 1979

[51] Int. Cl.[3] ..... F24C 1/14; F24D 1/00

[52] U.S. Cl. ..... 126/63; 126/61; 126/66; 126/67

[58] Field of Search ..... 126/110, 63, 87, 77, 126/121, 61, 66, 67; 431/114

[56] References Cited

U.S. PATENT DOCUMENTS

| | | | |
|---|---|---|---|
| 3,687,600 | 8/1972 | Gruswitz | 431/114 |
| 3,907,489 | 9/1975 | Santisi | 431/114 |
| 4,002,157 | 1/1977 | Toesca | 126/110 B |
| 4,056,091 | 11/1977 | Yeates | 126/121 |
| 4,092,976 | 6/1978 | Buckner | 126/121 |
| 4,127,100 | 11/1978 | Baker | 126/110 |

*Primary Examiner*—Samuel Scott
*Assistant Examiner*—Wesley S. Ratliff, Jr.
*Attorney, Agent, or Firm*—Leitner, Palan, Martin & Bernstein

[57] ABSTRACT

A forced air heating unit having a first U-shaped air channel with inlet vents adjacent the front, and a second U-shaped forced air channel interior said first forced air channel communicating with the first forced air channel via an opening in the common rear wall and having exit vents adjacent the front. A fan is mounted to the rear wall having the motor exterior the forced air channels with an impeller in the common rear wall opening. A conical deflector extends from the interior wall of the second forced air channel towards said rear wall opening. A refractory floor in the firebox includes front, side and rear vertical portions with top surfaces inclined towards the respective wall. The rear and side vertical portions exceed the height of a grate or andirons positioned on the refractory floor.

18 Claims, 6 Drawing Figures

THREE WALL FORCED AIR HEATING UNIT

BACKGROUND OF THE INVENTION

The present invention relates generally to heating units and more specifically, to a free-standing heater using forced air.

DESCRIPTION OF THE PRIOR ART

With the energy crisis and the increase in the expense of fuel, people have been preoccupied in maximizing the use of inexpensive fuels. A major effort has been made, to include heat collectors in fireplaces to collect the heat normally generated by wood-burning therein and to transfer it into the room more effectively than that provided by the standard fireplace. Prior art systems have generally included inserts around the back and side walls with a forced air unit to circulate the heat through the inserts, inserts to capture the heat escaping through the flue and to project it by forced air into the room, as well as other types of permanent systems using natural convection.

A major breakthrough in free-standing forced air systems is described in U.S. Pat. No. 4,092,976 to Buckner. The free standing system includes a generally U-shaped forced air system around the back and side walls of a firebox and a forced air system to insert air in the back of the forced air channel and to circulate around the back sides and bottom of the firebox to exit from the front of the heating unit into the room. This patent provided a great breakthrough in that by using a baffle system, forced air transverses a substantial portion of the back, sides and bottom of the firebox to maximize the capture of heat from the firebox. By mounting the fan and forced air systems on the exterior back wall of the air channel and introducing air at a high pressure against the rear wall of the firebox, undesirable vibration and noises are produced. Thus, there exists a need for a device which will eliminate the direct application of the forced air onto the back wall. Also, the fan motor is exposed to excessive heat from the rear wall, especially if the heating unit is installed in a fireplace.

Because the Buckner heating unit captures the maximum amount of heat that is available in the material to be burned, less fuel is needed to provide the desired heat. Since the general public is unaware of this capability, they build the large fires which they would generally use in a non-forced air stove or open fireplace. Because of such large fires, the forced air system is not generally capable of providing enough air in the forced air channels to capture all the heat. Consequently, the outer wall of the Buckner device becomes hotter than designed for and may be hot to the touch. Also, if the fan for the forced air system should fail, there exists a need for protection of the exterior walls from the excessive heat. Realizing this danger, the freestanding stoves are generally spaced from the wall of the room or are positioned on specially insulated walls and floors. In the free-standing model, there is a great deal of heat generated in the floor of the forced air chamber. Thus, there exists a need to minimize the size of the fire which can be built in a Buckner type device as well as providing some means to prevent the exterior walls from overheating.

Since the Buckner type device has become the major heating source in most of the users' homes, it is important that the device be capable of retaining heat in the firebox after the fire has died down. If such heat retention is provided, the user will not have to build an extremely large fire before going to sleep, nor, alternatively, have to wake up to continuously feed the fire. Thus, there exists a need for a device which will add heat retention to a Buckner type heating unit without interfering with the heat transfer characteristics needed.

A great demand for the Buckner type heating device has been to install them in pre-existing fireplaces. Since the Buckner device has a rear entry forced air system, vents must be provided in the front of the fireplace to allow air to be transmitted to the forced air system in the back of the heating unit. Similarly, the flue port of the heating unit must be connected to the chimney and separated from the forced air system to prevent contamination or re-introduction of exhaust fumes and gases into the room. Thus, there exists a need for a free-standing stove which may be easily installed into a pre-existing fireplace.

SUMMARY OF THE INVENTION

The present invention is a forced air heating unit which overcomes the problems of the prior art by improving on the Buckner device described in U.S. Pat. No. 4,092,976. Excessively hot side and back walls are eliminated by providing a second forced air channel surrounding the sides and back of the first forced air channel. The second air channel has an inlet vent on the front of the sides and communicates with the interior forced air channel through an opening in the common back wall. The forced air system or fan is mounted to the exterior of the back of the outer forced air channel and has its impeller in the opening communicating the two forced air channels. Air drawn in the front of the outer forced air channel cools the wall and is transmitted to the interior forced air channel by the fan through the rear opening. A conical deflector on the rear wall of the firebox disperses the air and prevents objectionable vibration and noises produced by the forced air. The exterior rear wall and the conical deflector thermally insulate the motor from the firebox. Openings are provided at the base of the conical deflector to prevent heat build-up in the cone. By providing inlet vents on the face of the unit, the unit is easy to install in the fireplace since the air can be easily isolated from the flue gases.

To reduce the size of the fire which can be built in the firebox, and provide a medium which will retain or store the heat after the fire has died down or gone out for efficient night operation, a refractory base is provided in the interior of the firebox. The refractory base includes a horizontal portion and front and rear vertical portions extending along the front and rear walls of the firebox. Preferably, vertical side portions are also provided along the side walls of the firebox. The back and side vertical portions of the refractory base have a height at least that of andirons or grate which supports the fire. The vertical refractory portions terminate in a top surface which is inclined towards the respective wall of the firebox to provide a self-feeding feature. To protect the floor upon which the heating unit is supported, a heat shield or reflector is mounted between the legs of the freestanding unit in addition to the thermal isolation provided by the refractor base.

OBJECTS OF THE INVENTION

An object of the present invention is to provide an improved forced air heating unit which reduces the heat of the exterior walls of the forced air channel.

Another object of the invention is to provide a heating unit which is easily installed in a fireplace.

A further object of the invention is to provide a forced air heating unit with means for maintaining and storing heat after the fire has been extinguished.

An even further object of the invention is to provide a means to minimize the size of the fire which may be built interior to a forced air heating unit.

A still further object of the invention is to provide a deflector for reducing the noise at the rear wall of the forced air unit.

A still even further object of the invention is to provide thermal insulation for the fan mounted to the forced air channel.

An even further object of the invention is to provide means to thermally insulate the floor from the forced air unit.

A still further object of the invention is to provide static means interior the firebox for feeding fuel placed therein.

Other objects, advantages and novel features of the present invention will become apparent from the following detailed description of the invention when considered in conjunction with the accompanying drawings.

DESCRIPTION OF THE PREFERRED EMBODIMENTS

Figure 2:
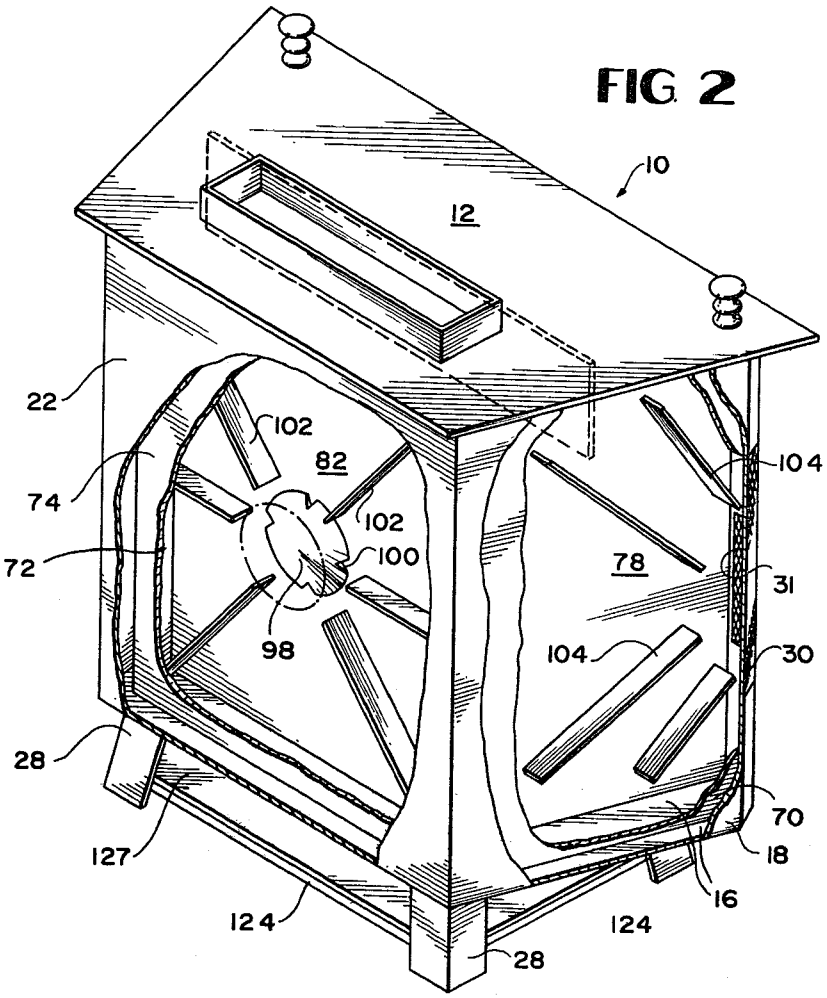
FIG. 2 is a rear cutaway perspective of the forced air heating unit illustrating the forced air channels and baffle system.
Figure 1:
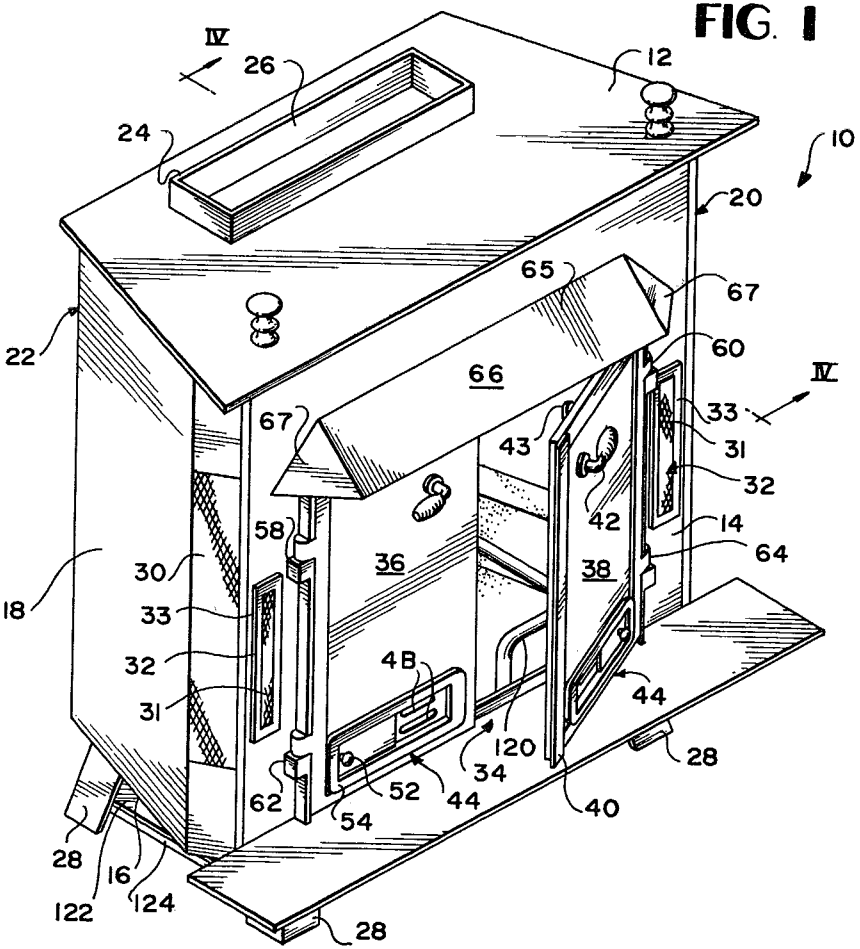
FIG. 1 is a front perspective view of a forced air heating unit employing the principles of the present invention.

FIG. 1, which illustrates a preferred embodiment of the forced air heating unit 10, shows a housing having top, front, bottom, two side and back walls, 12, 14, 16, 18, 20, and 22 respectively. Top wall 12, which is a single walled portion of the housing, extends past the front, back, and side walls, and includes a collar 24 surrounding an orifice or flue port 26. A flue (not shown) to remove the fumes from a source of heat or combustible material is connected to flue port 26 through the collar 24. The heating unit 10 is supported by four legs 28 providing space between the floor and the bottom wall 16. Front wall 14 has a pair of elongated vertical inlet vents 30 and outlet vents 32. The inlet vents 30 include a screen mounted between the front wall 14 and a respective side wall 18, 20 and the outlet vents 32 are covered by a screen 31 which is secured to the front wall 14 by a bracket or lip 33. The inlet vents 30 are at an obtuse angle relative to the outlet vents 32 so that warm air exiting the outlet vents are not drawn in by the inlet vents.

An access opening 34 in front wall 14 is covered by a closure including a pair of doors 36 and 38. The vertical exit vents 32 extend substantially the height of the opening 34 and are spaced from the bottom and top of the opening 34. The door 38 has a strip 40 which overlaps door 36 and holds door 36 closed and covers the space between the adjacent edges of the doors. Handle 42 on door 38 is connected to a latch 43 which engages the top interior portion above the opening 34 so as to lock the doors closed. The handle 42 rotates down to close, thus providing a gravity lock of the doors. A pair of posts (not shown) on the interior of the doors 38 provides stops for latch 43.

Also provided on each door 36 and 38 is a draft valve 44. A sliding portion 50 of draft valve 44 slides within guide member 54 to adjust the size of a plurality of elongated openings 48 in doors 36 and 38. When a fire is provided in the interior chamber of housing 10, the slide 50 adjustably varies the draft valve 44 to regulate the amount of air or draft introduced into the chamber and are locked in the adjusted position by threaded knobs 52. For a wood burning source of combustible material, this would vary the rate of burning as well as the temperature. This valve is used in conjunction with an adjustable flue port 26. The doors 36 and 38 are mounted to the housing by upper hinges 58 and 60 and lower hinges 62 and 64, respectively.

Also mounted to the front wall 14 is a hood 66 and a platform 68. The hood 66 traps any smoke pulled from the fire box at the upper edge of access opening 34 when the doors 36,38 are rapidly opened and directs it back into the fire box. The hood 66 includes a center portion 65 and a pair of side portions 67 for capturing the escaping gases and directing them back into the opening 34. The platform 68 provides a surface for supporting a fireplace screen when the heating unit 10 is used as a fireplace without doors.

The forced air system includes a source of forced air, two forced air channel systems, a baffle system and deflectors. The two air channels of the present device include a first channel between the exterior side, back and bottom walls 18, 20, 22, and 16 respectively and interior side and back walls 70, 72, and 74 and a second channel between interior side and back and exterior bottom walls 70, 72, 74 and 16 and firebox side, back and bottom walls 78, 80, 82, and 84 respectively. The side and back walls of the housing, the side and back interior walls and the side and back firebox walls form two generally U-shaped concentric forced air channels with the side walls at an angle other than ninety degrees relative to the back walls.

Figure 3:
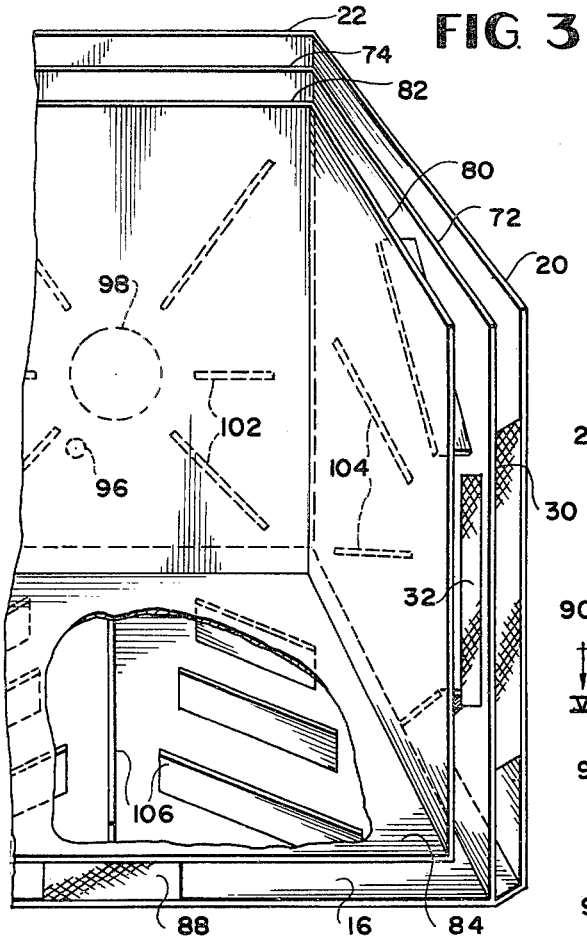
FIG. 3 is a front partial perspective of the bottom, back, and side walls of the forced air heating unit illustrating the forced air channels and the baffle system.

The first and second forced air channels communicate through an opening 76 in the common rear wall 74. The exterior side and back walls 18, 20, and 22 and the interior side and back walls 70, 72, and 74 are mounted directly to the bottom exterior wall 16 to provide the generally U-shaped first channel for forced air. The firebox side and back walls 78, 80, and 82 are mounted directly to the firebox bottom wall 84. This provides the generally U-shaped second forced channel in combination with a bottom forced air channel communicating with all three legs of the second generally U-shaped air channel. A horizontal vent 88, as illustrated in FIG. 3, is provided at the front of the bottom forced air channel. Air is drawn in by a forced air device or fan, to be more fully explained below, through inlet vents 30 traversing the first forced air channel, through rear opening 76 to the second forced air channel, to exit through exit vents 32 in the side and 88 in the bottom of the second forced air channel. This general flow pattern is illustrated in FIG. 5.

Figure 4:
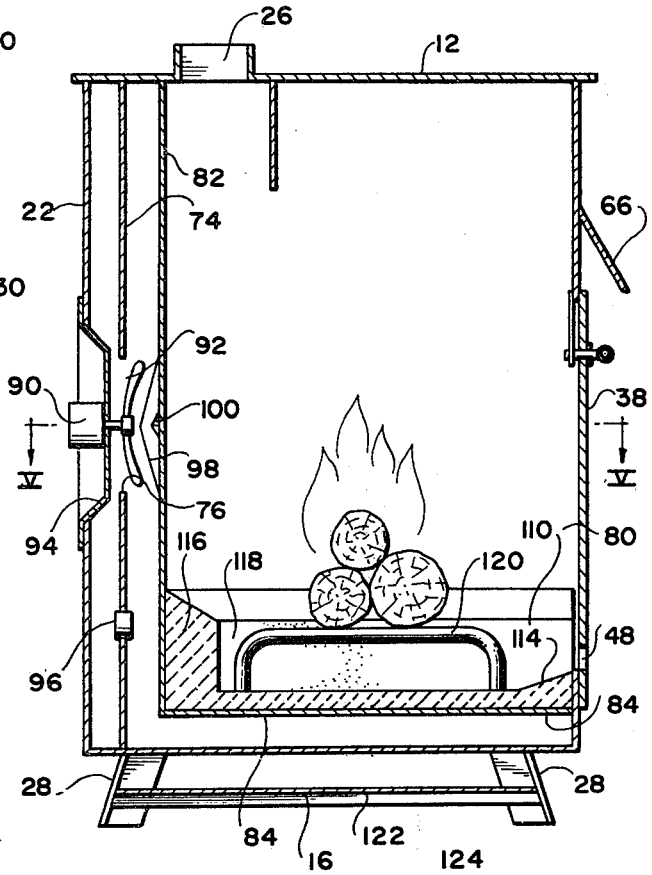
FIG. 4 is a crossectional view taken along lines IV—IV of FIG. 1.
Figure 5:
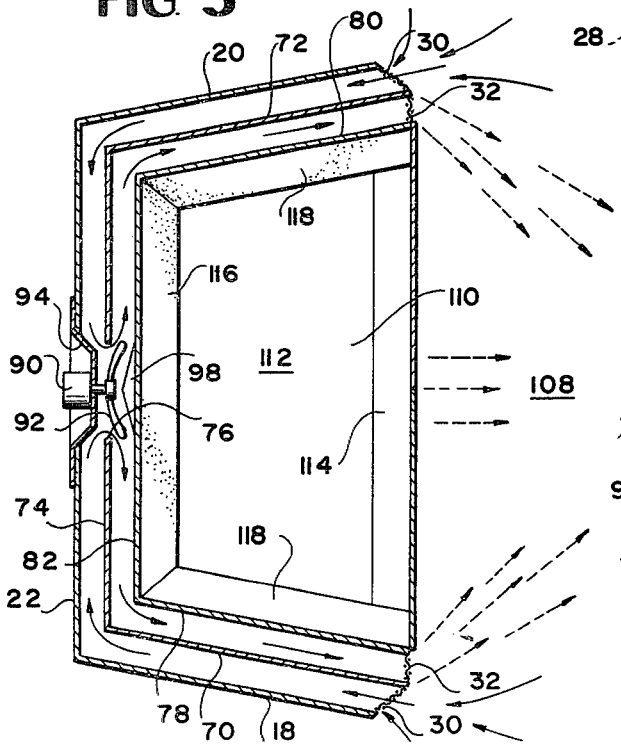
FIG. 5 is a crossectional view taken along lines V—V of FIG. 4.

The source of forced air is illustrated in FIGS. 4 and 5 as a fan including a motor 90 and impeller 92. The rear exterior wall 22 of the forced air channel includes a truncated pyramid-shaped wall 94 extending concavely inwards towards the interior wall 74. The motor 90 is mounted exterior the truncated pyramid 94, and is connected through a small opening to the impeller 92 which lies in the opening 76 in rear wall 74. At least two thirds of the impeller 92 must lie in the interior of second air channel for maximum pumping. Otherwise, some of the air is pumped back along the outer or first air channel. Preferably, the motor 90 does not extend past the plane defined by the rear wall 20, although a small projection can be tolerated. The convex rear wall 94 acts as an air guide, causing the air in the first air channel to converge towards the rear opening 76 in the common rear wall 74. Similarly, the concave rear wall 94 acts as a heat shield for the motor, separating it from the hot rear wall 82 of the firebox.

A thermostat 96 is provided on the interior rear wall 74 to sense the temperature of the air in the second forced air channel. The thermostat is part of the control system for a motor 90. Preferably, the thermostat 96 has two temperature ranges turning the fan on at a first temperature, and turning it off at a second temperature below the first temperature. This provides maximum heat transfer from the firebox through the firebox walls. Preferably, the range is between 95° F. to 150° F.

Within the second forced air channel, there is provided a baffle system to create specific air patterns which diverge from the fan at opening 76 and converge on the respective exit vents in the front of the second forced air channel. A conical deflector 98 is mounted to the rear firewall 82, extending towards the opening 76 in the common rear wall 74. The conical deflector 98 includes a plurality of triangular shaped openings 100 which prevent air from being trapped and heated between the conical deflector 98 and the rear wall 82. Without such openings, the hot air would cause the welds to pop. The resulting loose conical deflector produces undesirable vibrational noises. The function of the conical deflector 98 is to disperse the forced air produced by impeller 92 and spread it omnidirectionally along the rear wall 82. Thus the noise and vibration along the rear wall is reduced. Also, the conical deflector 98 provides another layer of thermal insulation to further reduce the possibility of damage to the motor 90. If more insulation is needed, the conical deflector 98 could be filled with a thermal insulation.

A plurality of baffles 102 in the rear wall portion of the second forced air channel aids in the radial directing of the forced air along the back of the channel towards the two wall channel portions and down into the bottom channel portion. Each side portion of the interior forced air channel includes a plurality of baffles 104 to cause the air received from the back and bottom channel to converge on the vertical exit vents 32. The bottom forced air channel includes a plurality of baffles 106 to distribute the forced air received from the rear air channel across the bottom wall 84 of the firebox and direct air towards the side forced air channels as well as towards the horizontal exit vent 88.

The first forced air channel does not include baffles since it is not critical that the air be dispersed completely over the interior walls 70, 72 and 74 since no heat transfer is taking place. Similarly, the vertical inlet vents 30 are substantially larger than the vertical exit vents 32 and consequently, air will be drawn in across a larger surface initially.

The specific design of the baffles and their location assures that the air traverses substantially all the firebox walls, thereby allowing a greater heat transfer from the firebox to the forced air without sacrificing the head of the air admitting from the exit vents 30, 32 and 88. The specific baffle systems disclosed produces a stream of air which is not troubled by eddy currents, dead air pockets, localized hot spots, and other disadvantages of the prior art baffle systems.

The forced air heating device 10 includes a system of deflectors at the vertical exit vents 32 to define a unique air flow pattern in front of the firebox opening 34. As illustrated in FIG. 5, the heated forced air (dashed lines) from vertical vents 30, 32 are directed towards each other to converge in front of the firebox opening 34 at a preselected distance. This creates an air pocket 108 in front of the firebox opening 34 in combination with the heated forced air exiting the bottom horizontal vent 88. The pneumatically created barrier or air pocket 108 limits the amount of air from which the fire can draw and thereby reduces the rate of combustion in the firebox. Also, the outward moving heated air reduces cold air drafts toward the access opening 34. The V-shaped pneumatic barrier is a critical substitute for the open or removed doors 36 and 38.

To retain and store heat within the firebox after the fire has gone out or died down, and to reduce the size of the fire which can be built within the device, refractory base 110 is provided as illustrated in FIGS. 4 and 5. The refractory base 110 includes a horizontal portion 112 having a front vertical portion 114, a rear vertical portion 116 and side vertical portions 118 extending up therefrom. The front vertical portion terminates in an inclined surface beginning at the horizontal portion 112 and being inclined towards the front wall. The back and side vertical portions 116 and 118 respectively extend above the top of andirons or grate 120 which will support the fire. This causes the ashes and the hot coals from the fire which fall through the andirons or grate to be surrounded by the back and side refractory materials so as to capture the majority of the heat there from and retain it for further use once the fire has died down. The front vertical portion 114 must not have a height greater than the opening 48 in the door. This would cut down or totally obstruct the flow of air through the andirons 120 to the fire.

The back and side vertical portions 116 and 118 terminate in an inclined surface inclining towards the respective wall of the fireplace. The inclination of the top surfaces prevent logs or other debris from accumulating thereon and consequently restricts the coals to rest upon the base 112 between the vertical portions. The inclined surfaces also provide a self-feeding feature. When a log greater than the size of the base 112 is placed in the firebox it rests across the vertical side portions 118. As the middle of the log burns through, the resulting two pieces will slide, by gravity, down the inclined surfaces into the fire in the middle of the firebox. This alleviates the need to open the doors to reposition the logs as they burn. This is most beneficial during the night while the people are asleep. The inclined front portion 114 aids in the removal of ashes.

Preferably, the refractory base is made from alumina-silica which is capable of being molded into the appropriate shape. Although alumina-silica is preferred, other types of refractory materials may be used. The essential element is that they be capable of being molded and of retaining heat after a fire has burned out. The refractory base may be molded in one piece and placed in the firebox or molded in the firebox. Because of the trapezoidal shape of the firebox floor, an externally molded refractory base must be molded in a plurality of parts. The total base could be molded as two pieces and placed within the fireplace. Preferably, the back and side portions 116 and 118 respectively are molded separately and the horizontal portions 112 and the front vertical portion 114 are molded as a unit. This four piece configuration permits easy removal for cleaning. By molding the refractory base in as few pieces as possible, it provides improved thermal characteristics over brick style liners.

Secured between the legs 28 is a thermal reflector 112, spaced from the bottom wall 116 and separating it from the floor on which the legs rest. Reflector 122 rests on four braces 124 secured between the legs 28. The reflector 122 and braces 124 may be secured to each other and the legs by welding or fasteners or any other device.

Preferred method of assembly of the forced air heating unit 10 is to form the exterior side and back walls 18, 20, and 22 from a single piece of material, the interior side and back walls 70,72, and 74 from a single piece of material and the firebox side and back walls 78, 80, and 82 from a single piece of material. The baffles are mounted to the interior side and back walls and the firebox side and back walls are mounted to the baffles preferably by welding. The bottom exterior wall 16 is welded to the exterior side and back walls 18, 20, 22 and to the interior side and back walls 70, 72, 74. The baffles of the bottom forced air chambers are mounted to the bottom exterior wall. The bottom firebox wall 84 is then joined to firebox side and back walls 78, 80 and 82. The top and front walls are then mounted to the structure by welding. The truncated pyramidial plate 76 with the fan secured thereto is mounted to the exterior back wall before or after assembly. The remaining elements are attached or mounted to the front wall.

Figure 6:
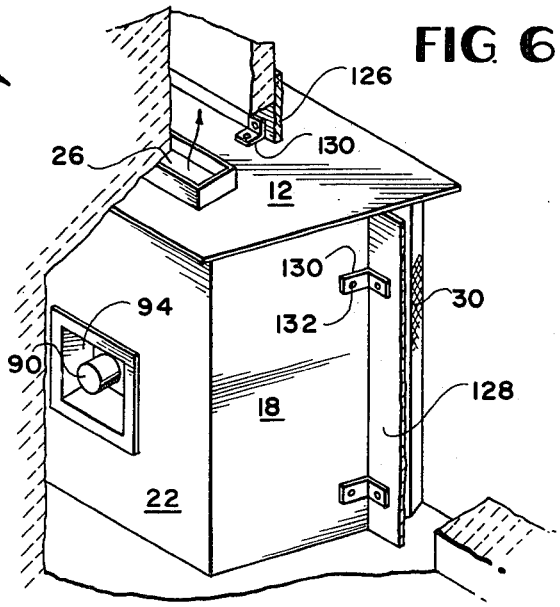
FIG. 6 is a cutaway perspective of the forced air heating unit of FIG. 1, in a fireplace.

By providing the first or exterior forced air channel concentric or outside the second or interior forced air channel, the outside wall is insulated from the hot firebox when a fire is built therein. This is considered critical if the forced air system should fail since it will keep the exterior most wall of the heating unit 10 as cool as possible. Similarly, by providing a cool air forced air channel around the hot air channel having inlet vents 30 adjacent to the front of the heating unit, the heating unit 10 is more easily installed in an existing fireplace. This is illustrated in FIG. 6. The installation merely requires removal of the legs 28 and placing the heating unit 10 in the fireplace with the vents 30 and 32 exterior the plane defining the opening of the fireplace. The area of the fireplace opening which is not occupied by the heating unit 10 is enclosed by a horizontal panel 126 and a pair of vertical panels 128, one on each side thereof. These panels are mounted directly to the heating unit 10 by generally L-shaped brackets 130 and fasteners 132. If preferred, the panels 126 and 128 may also be secured to the fireplace or may be secured only to the fireplace in lieu of mounting them to the heating unit 10. By completely encompassing the opening of the fireplace with the heating unit and the panels 126 and 128, the gases exiting the flue port 26 will be carried directly to the chimney of the fireplace and will not enter the room. The inlet vents 30 are exterior these partitions and thus the forced air system draws fresh air from the room and cannot draw in contaminated or exhaust gas from the flue port 26. Thus it can be seen that the present forced air heating unit 10 is easily installed into a fireplace. Similarly, it should be noted that no special attachment is needed between the flue port 26 and the chimney since the forced air system is totally isolated from the flue port and the chimney.

From the preceding description of the preferred embodiments, it is evident that the objects of the invention are obtained in that an improved forced air heating unit is provided. Although the invention has been described and illustrated in detail, it is to be clearly understood that the same is by way of illustration and example only and is not to be taken by way of limitation. The spirit and scope of the present invention is to be limited only by the terms of the appended claims.

We claim:

1. A forced air solid fuel heating unit comprising:

a bottom wall;

a top wall;

first means mounted between said bottom and top walls forming a back and two side walls;

a second means between said bottom and top walls interior said first means forming a back and two side walls and defining a first channel between said first and second means;

third means between said bottom and top wall interior said second means forming a back and two side walls and defining a second channel between said second and third means;

fourth means between said bottom and top walls forming a front wall across the side walls of said first, second and third means;

a firebox interior of said back and two side walls of said third means and an access opening in said fourth means to said firebox;

said back and two side walls of said first means also constituting said back and side walls of said solid fuel heating unit, said back and two side walls being spaced from said firebox by said first and second channels;

air inlet means in said fourth means between said first and second means;

air outlet means in said fourth means between said second and third means;

fifth means in said rear wall of said second means for pneumatically interconnecting said first and second channels;

and forced air means for forcing air in through said air inlet means into said first channel, through said fifth means into said second channel and out through said air outlet means.

2. The forced air heating unit according to claim 1 wherein said forced air means includes a motor exterior said first means and an impeller positioned in said fifth means and connected to said motor.

3. The forced air heating unit according to claim 2 wherein a portion of said first means opposite said fifth means is concave towards said fifth means and said motor is in said concave portion.

4. The forced air heating unit according to claim 1 wherein said third means includes a convex baffle extending towards said fifth means.

5. The forced air heating unit of claim 1 wherein said fourth means is substantially planar across said second and third means and is inwardly offset between said first and second means, said air outlet means including at least two outlet vent openings, said air inlet means including at least two inlet vent openings, and said inlet vent openings being at an obtuse angle relative to said outlet vent openings whereby air exiting the outlet vent openings is not drawn in the inlet vent openings.

6. The forced air heating unit of claim 5 wherein said forced air means includes a fan.

7. The forced air heating unit of claim 5 further including baffle means within said second channel.

8. The forced air heating unit of claim 7 wherein said baffle means includes baffle elements between the side walls of said second and third means to guide said forced air to said outlet vent openings.

9. The forced air heating unit of claim 8 wherein said baffle means further includes baffle elements between the back walls of said second and third means to disperse said air entering said second channel through said fifth means over substantially the entire rear and two side walls of said third means.

10. A forced air solid fuel heating unit having a firebox, an inner hot air channel having a rear portion and side portions exterior of and substantially encompassing the rear wall and side walls of the firebox, heat vent means in each of said inner hot air channel side portions, an opening in said rear portion of said inner hot air channel, an outer insulating air channel having a rear portion and side portions exterior of and substantially encompassing said rear portion and side portions of said inner hot air channel such that said rear portion and said side portions of said outer insulating air channel are spaced from said firebox by said rear portion and said side portions of said inner hot air channel respectively whereby each side wall of said forced air heating unit is spaced from said firebox by said inner hot air channel and said outer insulating air channel, air intake means in each of said outer insulating air channel side portions, said opening in said rear portion of said inner hot air channel fluidically connecting said inner hot air channel to said outer insulating air channel, and means for drawing air into said air intake means and forcing said air from said outer insulating air channel to said inner hot air channel along the rear portion of said inner hot air channel into said side portions and out said heat vent means.

11. The forced air heating unit of claim 10 wherein said inner hot air channel includes a bottom portion exterior of and substantially encompassing the bottom wall of said firebox, said bottom portion including heat vent means.

12. The forced air heating unit of claim 11 further including baffle means on said firebox back wall to move said air entering said rear portion of said inner hot air channel over substantially said entire firebox rear wall and into said side and bottom portion of said inner hot air channel.

13. The forced air heating unit of claim 12 further including a convex baffle mounted on said firebox back wall opposite said opening in said rear portion of said inner hot air channel for radially dispersing said air to said baffle means.

14. The forced air heating unit of claim 13 wherein said convex baffle is conical.

15. The forced air heating unit of claim 10 wherein said means for drawing air into said air intake means includes a fan.

16. The forced air heating unit of claim 10 wherein said means for drawing air into said air intake means includes a motor exterior to said outer insulating air channel and an impeller positioned substantially in said rear portion of said inner hot air channel.

17. The forced air heating unit of claim 16 wherein a portion of the exterior wall of said outer insulating air channel opposite said opening is concave toward said opening and said motor is in said concave position.

18. The forced air heating unit according to claim 10 wherein the heating unit includes a plurality of legs separating the bottom of the heating unit from the floor and means mounted between the legs interposed between the floor and the bottom of the heating unit for reflecting the heat from the bottom of said heating unit back towards the bottom of the heating unit.

* * * * *